United States Patent [19]

Waltemath

[11] 4,171,783

[45] Oct. 23, 1979

[54] FILAMENT DEREELING APPARATUS

[75] Inventor: John W. Waltemath, Fort Wayne, Ind.

[73] Assignee: Phelps Dodge Industries, Inc., New York, N.Y.

[21] Appl. No.: 905,339

[22] Filed: May 12, 1978

[51] Int. Cl.[2] ..... B65H 17/08

[52] U.S. Cl. ..... 242/128; 242/129.8

[58] Field of Search ..... 242/47.01, 128, 147 R, 242/129.62, 129.8

[56] References Cited

U.S. PATENT DOCUMENTS

| | | | |
|---|---|---|---|
| 2,258,153 | 10/1941 | Siebs | 242/128 |
| 2,479,826 | 8/1949 | Frick et al. | 242/128 |
| 2,552,086 | 5/1951 | Bugg | 242/128 |
| 3,995,786 | 12/1976 | Deniega | 242/47.01 |

*Primary Examiner*—Leonard D. Christian

*Attorney, Agent, or Firm*—Lundy and Associates

[57] ABSTRACT

An apparatus for dereeling a filament wound on the barrel of a spool between opposite flanges. The dereeling apparatus comprises a rim adapted to be positioned on the upper flange of a spool resting on its other flange. Both the spool and the rim are stationary. The rim having an outwardly facing filament-contacting surface for training the dereeling filament out of contact with the upper spool flange and radially extending filament control members for resisting the movement of the dereeling filament around the upper spool flange.

21 Claims, 4 Drawing Figures

FILAMENT DEREELING APPARATUS

BACKGROUND OF THE INVENTION

The invention relates to an improved filament dereeling apparatus, and in particular, to an improved apparatus for dereeling copper or aluminum wire or magnet wire from spools.

In the past, filament breakage and damage to filaments resulting during dereeling operations has always been a problem of some concern. Thus, it would be desirable to provide an improved filament dereeling apparatus that would reduce filament breakage and damage to filaments.

In particular, damage to a filament can be caused by a dereeling filament contacting the flange of the spool from which it is dereeled. The peripheral portions of the spool flanges often become rough due to wear, and are more than capable of damaging copper, aluminum and magnet wire. Thus, it would be highly desirable to provide an improved filament dereeling apparatus that prevents the filament from contacting the spool flange.

During the dereeling of the filament, the filament "whips" around the spool, and both filament breakage and damage to the filament can be caused by the whipping action of the dereeling filament. Thus, it would be desirable to provide an improved filament dereeling apparatus that would limit or control the "whipping action" of the dereeling filament.

During the dereeling operation, the filament dereeling apparatus can experience problems caused by it being movable with respect to the spool. The inertia of moving parts can break filaments. Maintenance has also been a problem with respect to movable-type dereeling apparatus. Thus, it would be highly desirable to provide an improved filament dereeling apparatus that would eliminate all moving parts and is stationary with respect to the spool during operation.

During its operation, the filament dereeling apparatus also experiences breakage of parts, especially the filament-contacting portions thereof. Thus, it would be highly desirable to provide an improved filament dereeling apparatus which has replaceable filament-contacting parts that can be easily replaced when desired.

The applicant is aware of a dereeling apparatus marketed under the name "WIRE-WHISK" by J & L Machinery & Welding, 605-G Country Club Drive, Bensonville, Ill. 60106. However, the applicant makes no representation or admission that the "WIRE-WHISK" apparatus is "prior art" with respect to his invention under the Patent laws of the United States of America. In contradistinction to applicant's invention, the "WIRE-WHISK" structure is rotatable with respect to the spool.

SUMMARY OF THE INVENTION

It is a primary object of the invention to provide an improved filament dereeling apparatus.

It is also an object of the invention to provide an improved filament dereeling apparatus which has usefulness with copper, aluminum and/or magnet wires.

It is also an object of the invention to provide an improved filament dereeling apparatus that prevents the filament from contacting the spool flange.

It is also an object of the invention to provide an improved apparatus for dereeling filaments from spools.

It is also an object of the invention to provide an improved filament dereeling apparatus that limits or controls the whipping action of the dereeling filament.

Further, it is another object of the invention to provide an improved filament dereeling apparatus that is stationary with respect to the spool during operation.

Finally, it is an object of the invention to provide an improved filament dereeling apparatus that includes replaceable filament-contacting portions that can be easily replaced as desired.

The filament dereeling apparatus of the invention comprises a rim adapted to be positioned on the upper flange of a spool resting on its other flange. Both the rim and the spool are stationary. The rim having first means thereon for training the dereeling filament out of contact with the upper spool flange and second means thereon for resisting or controlling the movement of the dereeling filament around the upper spool flange.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DETAILED DESCRIPTION OF A SPECIFIC EMBODIMENT

Figure 1:
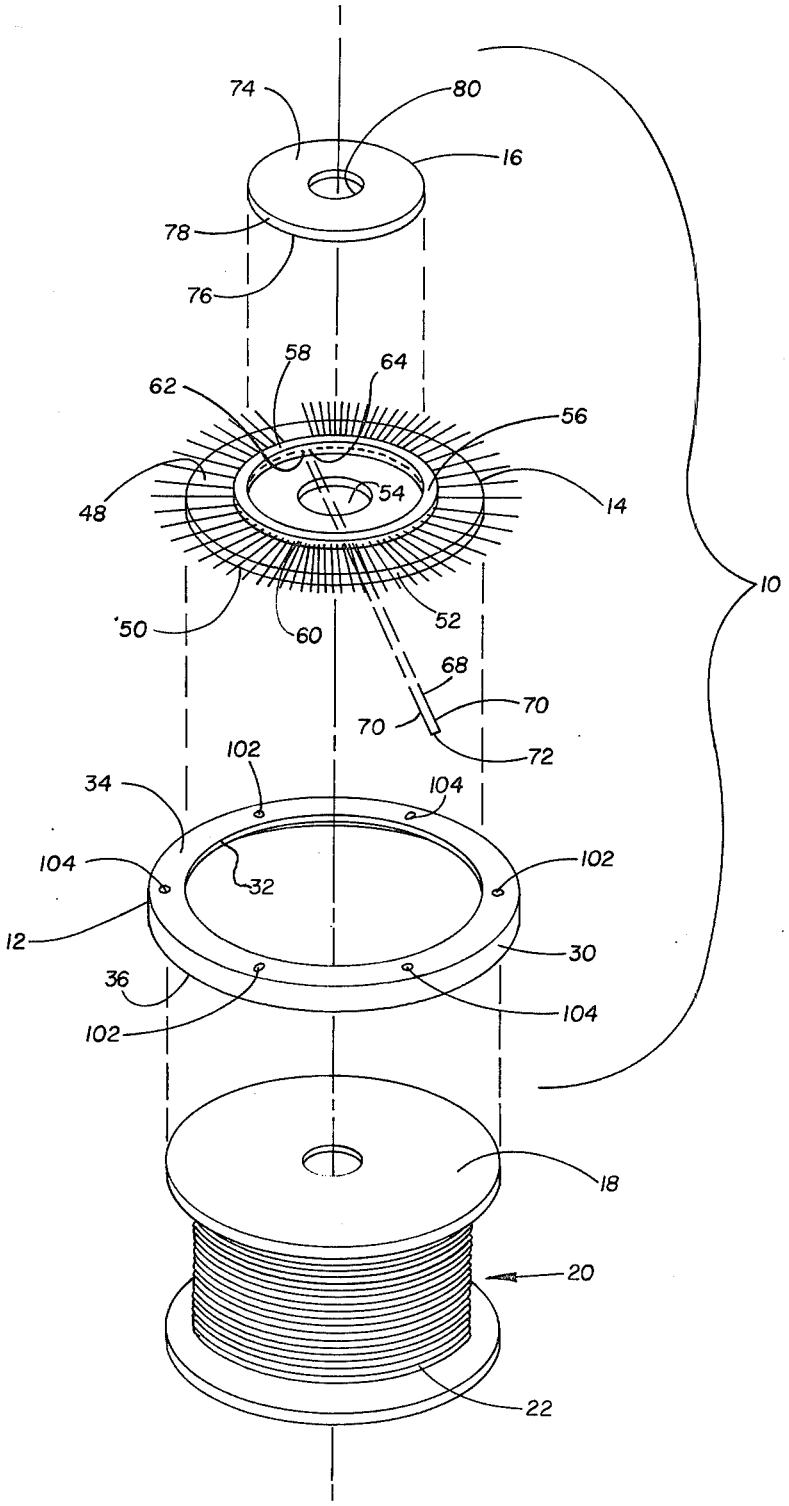
FIG. 1 is a perspective view of a specific embodiment of the invention and a spool wherein the outer rim, support disc and retainer disc of the specific embodiment are vertically exploded apart, and a filament control member is horizontally exploded from the support disc.

As illustrated in FIG. 1, a specific embodiment of applicant's dereeling apparatus 10 comprises an outer rim 12, a support disc 14 and a retainer disc 16. The support disc 14 is connected to the rim 12 and the retainer disc 16 is connected to the support disc 14. The filament dereeling apparatus 10 is frictionally connected to one flange 18 of the spool 20 and remains stationary with respect to the spool 20 throughout the entire filament dereeling operation. A filament 22 is contained around the barrel 24 of the spool 20. As will become apparent below, applicant's filament dereeling apparatus 10 dereels filament 22 from the spool 20 in an improved fashion.

Rim 12 is annular and includes a radially outward facing rim surface 30 and a radially inward facing rim surface 32. The radially outward facing filament-contacting rim surface 30 is radiused about a horizontal circular axis 38 and is smooth such that the dereeling filament 22 has minimum contact therewith, thereby minimizing the chances that filament 22 would not become damaged due to contact with the surface 30. In a specific embodiment, for use with 8" and 12" diameter spools, the rim is 12" and 16" in diameter and the radially outwardly facing rim surface 30 is of a 11/16" and 11/16" radius, respectively. Further, the rim 12 includes a top surface 34 and a bottom surface 36. Downwardly facing surface 34 has a cylindrical bore 40 therein. Upwardly facing surface 34 has a cylindrical bore 42 therein extending between upwardly facing surface 34 and the bottom of bore 40. Bore 40 is larger than and coaxial with bore 42.

Support disc 14 has top 48 and bottom 50 surfaces and an outwardly facing circumferential edge surface 52, as well as a centrally-located aperture 54. A ring-shaped protuberance or boss 56 is formed on the top surface 48 of the support disc 14 and is positioned between the circumferential edge 52 and the centrally-located aperture 54.

The protuberance 56 includes a top surface 58 and outwardly 60 and inwardly 62 facing surfaces. A plurality of equally circumferentially-spaced horizontal cylindrical shafts 64 pass through the protuberance 56 so that the opposite openings 66 thereof are located in the outwardly 60 and inwardly 62 facing surfaces.

A plurality of filament control members 68 are removably contained within the horizontal cylindrical shafts 64. Consequently, each filament control member 68 is equally spaced apart. Each filament control member 68 is U-shaped and comprises a pair of radially extending sections 70 connected by a base section 72. As positioned on support disc 14, the base section 72 is contiguous with the inwardly facing protuberance surface 62 and both radially extending filament control member sections 70 are contained within the horizontal cylindrical shafts 64 and extend in a radially outward fashion from the protuberance 56.

The material of which the filament control members 68 are comprised has certain mechanical properties (e.g. flexibility, fatigue strength, stiffness and the like) and certain physical dimensioning (e.g. length, diameter and the like) which are essential to proper operation of the dereeling apparatus 10. These matters will be discussed in detail below.

The retainer disc 16 is a circular disc having a top 74 and bottom 76 surface, a centrally-located aperture 80 and a circumferential edge surface 78.

The support disc 14 also has a downwardly extending annular protuberance or boss 82. The support disc 14 rest on the rim 12 with the boss 82 positioned in the bore 42 of the rim 12. The filament control members 68 are positioned within the horizontal cylindrical shafts 64 of the protuberance 56, and the retainer disc 16 is press fit within the protuberance 56. The circumferential edge 78 of the retainer disc is contiguous with the filament control base sections 72 so as to sandwich the base sections 72 between the protuberance 56 and the disc 16 and maintain the position of the filament control members 68 within the shafts 64. In this manner the filament control members are removably connected to rim 12 and extend radially over rim 12 and beyond in cantilever fashion.

Figure 4:
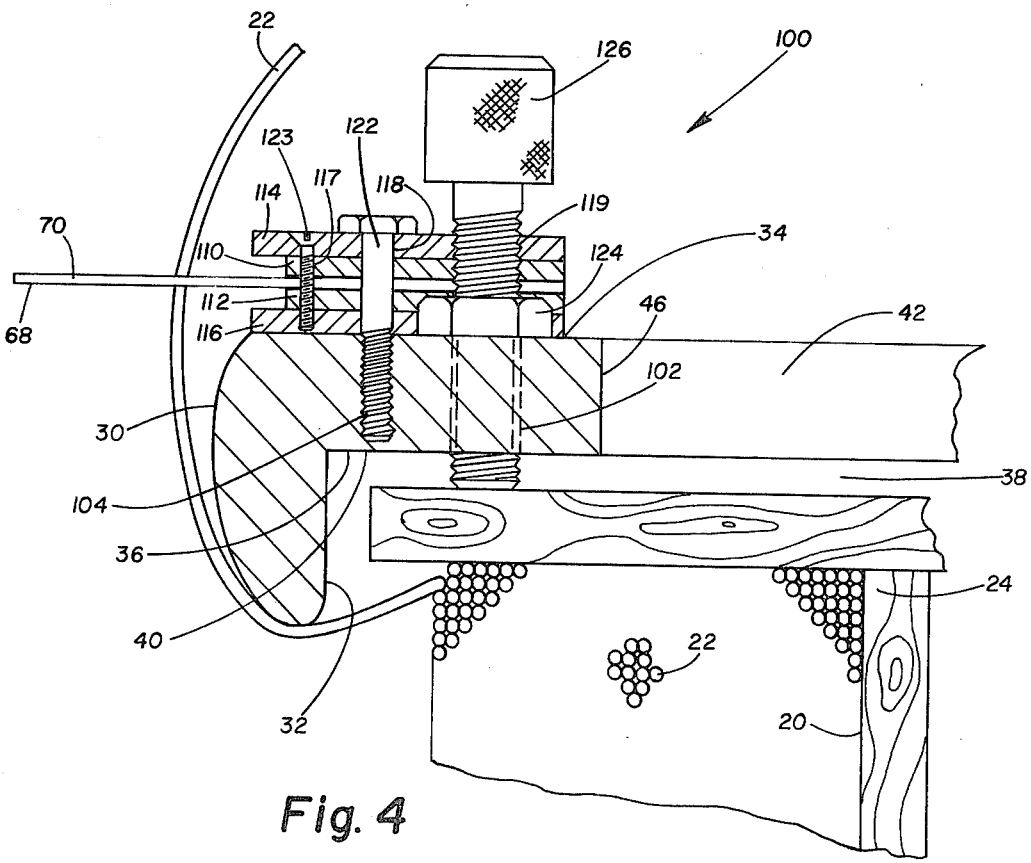
FIG. 4 is a view similar to FIG. 3 of another specific embodiment of the invention which includes an adjustment or levelling attachment and which has the support disc and retainer disc removed.

In FIG. 4, a specific embodiment of the filament dereeling apparatus 10 of the invention is illustrated which includes a levelling and filament-holding apparatus 100 designed to selectively adjust the distance between the filament dereeling apparatus 10 and the spool flange 18 and to hold the filament control members 68. The apparatus 100 includes a plurality of shafts 102 passing completely through the rim 12 adjacent the interior edge surface 46, and a plurality of threaded holes 104 tapped into the top surface 34 of the rim 12 adjacent the radially outwardly facing rim surface 30, as well as a pair of annular rubber clamp pads 110, 112, a pair of annular plates 114, 116 to sandwich the rubber pads 110, 112 together. Both shafts 102 and apertures 104 are circumferentially spaced around rim 12.

The lower plate 116 is contiguous to the top surface 34 of the rim 12 adjacent the radially outward facing rim surface 30. The filament control members 68 are sandwiched between the rubber clamp pads 110, 112, which are, in turn, sandwiched between the upper 114 and lower 116 plates.

A trio of spaced-apart aperture sets 117, 118, 119 are contained within the upper plate 114, lower plate 116, upper clamp pad 110 and lower clamp pad 112. An attaching screw 122 is threadedly contained within each aperture of aperture set 118 and threaded holes 104. A tension clamp screw 123 is threadedly contained within each aperture of aperture set 117. A jam nut 124 is positioned over each shaft 102 in rim 12. A threaded levelling screw 126 is threadedly contained within each aperture of aperture set 119, and is positioned in each vertical shaft 102. Levelling screws 126 extend below the bottom surface 36 of rim 12. The distance that rim 12 is spaced-apart from the top spool flange 18 can be selected by operating (rotating) the levelling screw 126.

Figure 2:
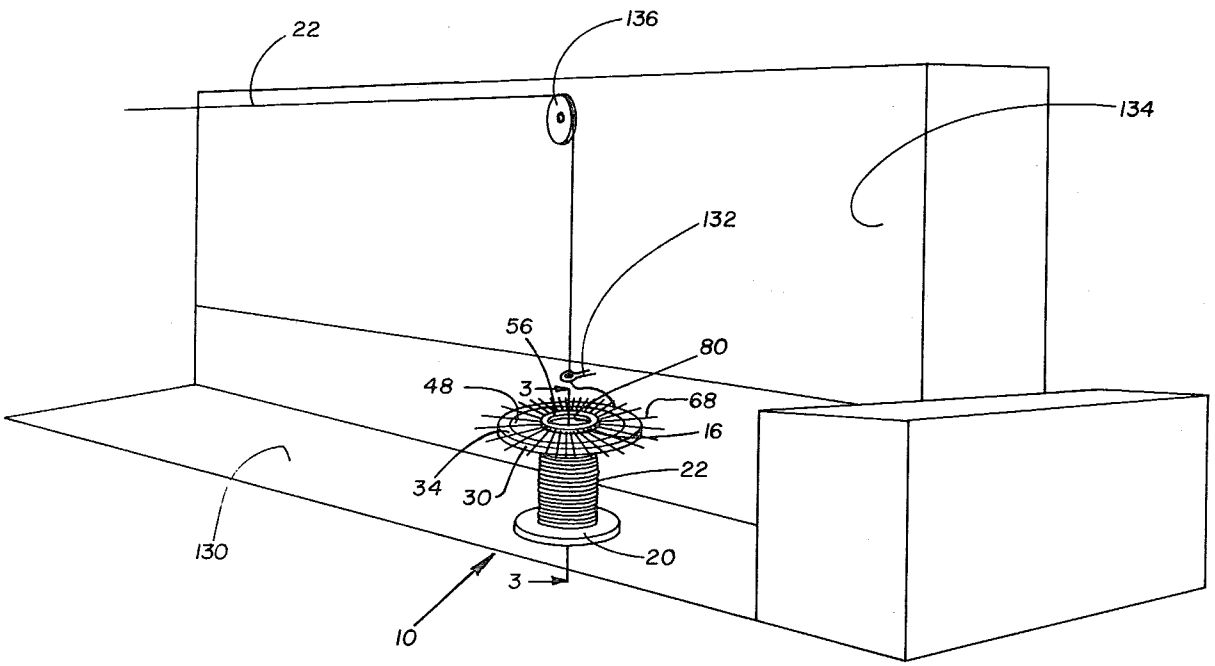
FIG. 2 is a perspective view of a production assembly showing the specific embodiment of FIG. 1 connected to the spool and a filament trained through an eyelet coaxial with the spool but vertically spaced from the spool.
Figure 3:
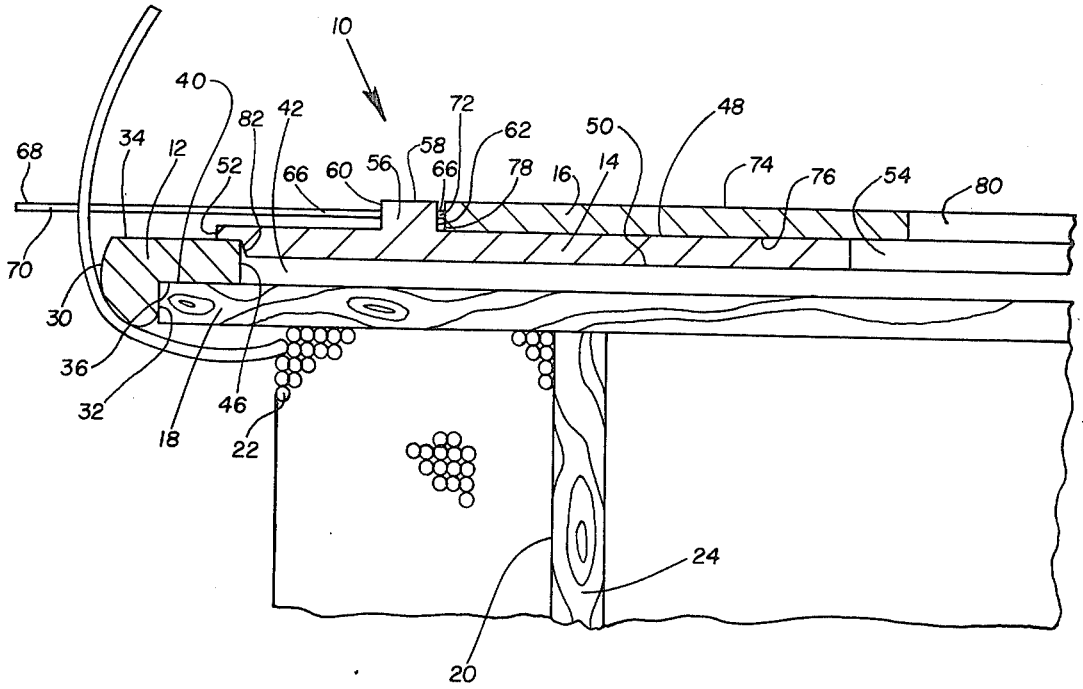
FIG. 3 is a fragmentary and cross-sectional view of the specific embodiment of FIG. 1 taken substantially along section line 3—3 of FIG. 2.

In FIG. 2, the filament dereeling apparatus 10 of the invention is illustrated as used with a production assembly. In particular, a spool 20 is positioned on a vertical spindle (not illustrated because hidden) which projects from the floor 130. The top flange 18 is received into the bore 40 of rim 12 thereof, connecting the filament dereeling apparatus 10 frictionally to the spool 20. The filament 22 is trained over the radially outward facing filament contacting rim surface 30 and is threaded through an eyelet 132 supported on the upstanding wall 134 adjacent the spool 20. Eyelet 132 is on the same axis as spool 20 and apparatus 10. The filament 22 travels vertically up to and is extended over a directional take-up pulley 136 and then horizontally.

The filament 22 dereels from the spool 20 in such a fashion that it travels around the circumference of rim 12. The filament 22 contacts the radially outward facing rim surface 30 as it dereels from spool 20; however, any particular point along the length of the filament 22 generally contacts only one point on the radially outward facing rim surface 30.

The dereeling filament 22 never contacts the top spool flange 18 because the bottom surface 36 of the rim 12 extends below the bottom surface of top spool flange 18 a sufficient distance to prevent such contact. The prevention of contact between the spool flange 18 and the filament 22 reduces filament breakage as well as filament damage experienced if the filament 22 were to contact the spool flange 18. As disucussed earlier, the spool flanges 18 often become rough due to wear.

Due to the relatively high speed at which the filament 22 is dereeled, the filament 22 is caused to "whip" around the apparatus 10 when passing from the spool 20 to the directional take-up pulley 136. Uncontrolled "whipping" action is undesirable since it can damage the filament 22. The filament control members 68 projecting from the support disc 14 restrict and control the whipping of the dereeling filament 22 by keeping the filament 22 in tension throughout the dereeling operation. A more consistent tension is developed because the filament control members 68 are equally circumferentially spaced. However, as will be discussed below, the filament control members 68 must exhibit additional characteristics.

The filament dereeling apparatus 10 remains stationary with respect to the spool 20 through the dereeling operation. This is a particularly desirable characteristic since there are no moving parts to build up momentum during the dereeling operation. Such momentum causes filament breakage as dereeling speeds are changed. Consequently, when dealing with fragile filaments 22, especially when dereeled at variable speeds, the applicant's invention provides excellent performance results and significantly less filament breakage and filament damage.

The material from which the filament control members 68 are made must have sufficient stiffness to keep the filament 22 tension, yet must be sufficiently flexible and resilient to allow the filament 22 to pass. In particular, the filament 22 must pass without having its exterior surface or any coating thereon, being damaged, removed or destroyed.

The physical properties o the material of the filament control member 68 itself and the physical dimensioning of the filament control members 68 are critical to the filament control members 68 performance in the invention. Specifically, the material of the members 68 must be tough, wear resistant, flexible, self-supporting and resilient in the presence of ambient temperatures, moisture and corrosive atmospheres, and resists aging and fatigue from bending. The length of the filament control member 68, the distance the filament control member 68 extends past the radially outward facing rim surface 30, and the diameter of the filament control member 68 are physical dimensions that effect the performance of the filament control member 68. A specific length and diameter of the filament control member 68 may only be determined in response to a particular filament 22, and thus, may vary with the filament 22. However, one general rule provides that filament control members 68 should extend past the radially outward facing rim surface 30 a distance greater than the maximum distance that filament 22 is spaced from the rim 12 during the dereeling operation. As the length of the members 68 increases, the resistance to the movement of the dereeling filament around the spool flange also increases. This is due to the fact that when the distance that members 68 extend past rim 12 is greater than the maximum distance that the filament 22 is spaced from rim 12 during the dereeling operation, more than one member 68 will always be in contact with the members 68. In a specific embodiment, the members 68 extend past the rim 12 at least five times the distance that the dereeling filament 22 is spaced during the dereeling operation in order to provide optimum whip limiting action.

The applicant's filament dereeling apparatus 10 will eventually experience failure of the filament control members 68 regardless of the steps taken to prolong such operational life. One principle type of filament control members 68 failure is due to fatigue-generated fracture at a point adjacent the protuberance 56. In a situation where a filament control member 68 becomes inoperable (i.e. through fracture or some type of breakage), it can be replaced by being removed from the horizontal cylindrical shafts 64 and a replacement filament control member 68 substituted in its place.

In a specific embodiment of applicant's filament dereeling apparatus 10, the material out of which the filament control members 68 are made is a nylon filament marketed by the E. I. Dupont De Nemours & Company (Inc.) under the trademark "TYNEX" and the filament control members have a diameter from about 0.032 to about 0.017 inches in diameter and are approximately 4" long and extend beyond rim 12 approximately 1".

In addition, the whole of the "Technical Data" publications relating to the "TYNEX" nylon filament are hereby incorporated by reference. The particular publications are set forth below (all of which have been distributed by the E. I. Dupont De Nemours & Company, (Inc.), Plastics Department, Wilmington, Del. 1989):

| Title | Identification No. |
|---|---|
| Technical Data Bulletin No. 1 Stiffness of TYNEX and HEROX Nylon Filaments | A77627 9/71 |
| Technical Data Bulletin No. 2 Chemical Resistance of TYNEX and HEROX Nylon Filaments | A77628 9/71 |
| Technical Data Bulletin No. 3 Abrasion Resistance and Some of the Factors that Affect Brush Wear-Rate | A77644 3/72 |
| Technical Data Bulletin No. 5 Bend Recovery of TYNEX and HEROX Nylon Filaments | A77631 9/71 |
| Technical Data Bulletin No. 6 Fatigue Resistance and Some of the Factors That Affect Flex Life of Brush Filling Materials | A77632 9/71 |

It can be seen that the applicant has invented an improved filament dereeling apparatus.

The applicant's invention provides a structure that prevents the dereeling filament 22 from contacting the spool flange 18, which, in turn, reduces filament damage and breakage.

The applicant's invention further provides structure that controls the whipping of the dereeling filament 22. In particular, the filament 22 is kept in tension by equally circumferentially spaced filament control members 68. The equal spacing of the filament control members 68 provides excellent whip controlling characteristics for all sizes of filaments 22.

The filament control members 68 are stationary with respect to the spool 20, and consequently, have very good performance characteristics with respect to small diameter filaments 22, for example the fine wire sizes. The applicant's invention provides filament control members 68 that are replaceable so that damage to one filament control member 68 will not make the entire filament dereeling apparatus 10 inoperable.

Finally, the applicant's invention provides filament control members 68 that have sufficient stiffness to perform the whip limiting function and sufficient flexibility to allow the filament 22 to be dereeled without damaging the filament 22.

While there have been described above the principles of this invention in connection with specific apparatus, it is to be clearly understood that this description is made only by way of example and not as a limitation to the scope of the invention.

What is claimed is:

1. An apparatus for dereeling a filament wound on the barrel of a spool between the opposite flanges thereof comprising a rim adapted to be positioned on the upper one flange of a spool resting on its other flange, both said spool and said rim being stationary, said rim having a portion thereof extending downwardly over said one spol flange, said rim portion having an outwardly facing smooth filament-contacting surface facing radially outwardly thereof, said rim having a plurality of elongated filament control members, said filament control members being flexible and resilient, said filament control members extending radially of said spool and outwardly past said filament-contacting surface of said rim in cantilever fashion, whereby the dereeling filament is trained out of contact with said spool flange and the movement of said dereeling filament around said spool flange is resisted by said control members.

2. The apparatus of claim 1 wherein said rim surface is part-annular.

3. The apparatus of claim 1 wherein said filament control members extend over a portion of said rim adjacent said filament-contacting surface in cantilever fashion.

4. The apparatus of claim 1 further comprising a filament guide positioned over said rim and coaxial with said spool in a spaced-apart relationship with said spool and rim.

5. An apparatus for dereeling a filment wound on the barrel of a spool between the opposite flanges thereof comprising a rim adapted to be positioned on the upper one flange of a spool resting on its other flange, both said spool and said rim being stationary, said rim having first means thereon for training the dereeling filament out of contact with said spool flange, said rim also having second means thereon for resisting the movement of the dereeling filament around said spool flange, said rim including both a downwardly facing bore and an upwardly facing bore, said one spool flange being positioned in said downwardly facing bore.

6. The apparatus of claim 5 further comprising a filament control member support ring, said support ring having both an upwardly facing annular boss and a downwardly facing annular boss, said support ring resting on said rim, said downwardly facing boss of said support ring positioned in said upwardly facing bore of said rim.

7. The apparatus of claim 5 wherein said upwardly facing boss has a plurality of apertures therein extending radially of said support ring and generally perpendicular to the axis thereof.

8. The apparatus of claim 7 wherein one of said elongated filament control members is positioned in each of said apertures, said upwardly extending boss being spaced from the periphery of said support ring.

9. The apparatus of claim 8 wherein said apertures are equally spaced apart circumferentially of said support ring.

10. The apparatus of claim 8 wherein each of said filament control members is generally U-shaped having a base portion and a pair of leg portions, said leg portions extending generally parallel from said base portion, said leg portions of one of said filament control members being positioned within adjacent apertures of said support ring, said base portion of said one filament control member being contiguous with the inwardly facing surface of said upstanding boss.

11. The apparatus of claim 10 further including a retaining ring, said retaining ring fitting within said upstanding boss of said support ring, said retaining ring holding the base members of said filament control members between said inwardly facing surface of said upstanding boss of said support ring and the periphery of said retaining ring.

12. An apparatus for dereeling a filament wound on the barrel of a spool between the opposite flanges thereof comprising a rim adapted to be positioned on the upper one flange of a spool resting on its other flange, both said spool and said rim being stationary, said rim having first means thereon for training the dereeling filament out of contact with said spool flange, said rim also having second means thereon for resisting the movement of the dereeling filament around said spool flange, and means for adjusting the distance between said rim and said one spool flange.

13. The apparatus of claim 12 wherein said adjusting means comprises a plurality of bores extending through said rim, said bores being circumferentially spaced apart around said rim, a plurality of threaded members, each of said members being positioned in one of said bores, said members extending through said rim and engaging said one spool flange.

14. The apparatus of claim 13 further comprising means for locking said threaded members to said rim.

15. The apparatus of claim 1 further comprising a pair of annular plates, said filament control members being positioned between said plates, and means for securing said plates to said rim and squeezing said plates together.

16. The apparatus of claim 4 further comprising means for adjusting the distance between said rim and said one spool flange, said adjusting means comprises a plurality of bores extending through said rim, said bores being circumferentially spaced apart around said rim, a plurality of threaded members, each of said members being positioned in one of said bores, said members extending through said rim and engaging said one spool flange, a pair of annular plates, said filament control members being positioned between said plates, and means for securing said plates to said rim and squeezing said plates together, said upper plate extends inwardly of said lower plate, said upper plate having bores extending therethrough inwardly extending portion of said lower plate, said threaded members being positioned in said bores of said upper plate.

17. The apparatus of claim 1 wherein said filament control members extend past said rim a distance greater than the maximum distance that said filament is spaced from said rim during dereeling.

18. The apparatus of claim 17 wherein filament control members extend beyond said rim a distance equal to approximately five times the distance that said filament is spaced from said rim during dereeling.

19. The apparatus of claim 1 wherein said filament control members are of a material which is tough, resistant, flexible and resilient in the presence of ambient temperatures, moisture and corrosive atmospheres, and resists aging and fatigue from bending.

20. An apparatus for dereeling a filament wound on the barrel of a spool and between the opposite flanges thereof comprising a rim adapted to be positioned on one flange of a spool resting on its other flange, said rim having a portion thereof extending downwardly over said one spool flange, said rim having an outwardly facing smooth filament-contacting surface, a plurality of elongated filament control members, said filament control members being flexible and resilient, said filament control members extending radially outwardly of said rim and being circumferentially spaced about said rim, means for removably connecting said filament control members to said rim, said filament control members extending over a portion of said rim and beyond said filament-contacting surface in cantilever fashion, whereby a filament is trained over said filament contacting surface and between said filament control members as said filament is dereeled from said spool.

21. A filament dereeling apparatus comprising a spool having a barrel and opposite flanges, said spool resting on one flange thereby defining an upper flange, a rim adapted to be positioned on said upper flange, said rim having a portion thereof extending downwardly over said upper flange, said rim having an outwardly facing smooth filament-contacting surface, a plurality of elongated filament control members, said filament control members being flexible and resilient, means for positioning said filament control members to extend radially of said spool and outwardly past said filament-contacting rim surface in cantilever fashion and removably connecting said filament control members to said rim, said filament control members being circumferentially spaced about said rim, an eyelet, said eyelet being positioned over said rim, said eyelet and rim and spool being on the same axis, whereby a filament is trained over said filament contacting surface and between said filament control members and said through said eyelet as said filament is dereeled from said spool.

* * * * *

UNITED STATES PATENT OFFICE

CERTIFICATE OF CORRECTION

Patent No. 4,171,783 Dated October 23, 1979

Inventor(s) John W. Waltemath

It is certified that error appears in the above-identified patent and that said Letters Patent are hereby corrected as shown below:

Column 5, Line 22 between "properties" and "the" change "o" to "of".

Column 7, Line 2 between "one" and "flange" change "spol" to "spool".

Signed and Sealed this

*Eighteenth* Day of *November 1980*

[SEAL]

*Attest:*

SIDNEY A. DIAMOND

*Attesting Officer*

*Commissioner of Patents and Trademarks*